US006974306B2

(12) United States Patent
Djeridane et al.

(10) Patent No.: US 6,974,306 B2
(45) Date of Patent: Dec. 13, 2005

(54) BLADE INLET COOLING FLOW DEFLECTOR APPARATUS AND METHOD

(75) Inventors: Toufik Djeridane, Saint Bruno (CA); Michael Leslie Clyde Papple, Ile des Soeurs (CA); Nicholas Grivas, Dollard des Ormeaux (CA)

(73) Assignee: Pratt & Whitney Canada Corp., Longueuil (CA)

( * ) Notice: Subject to any disclaimer, the term of this patent is extended or adjusted under 35 U.S.C. 154(b) by 136 days.

(21) Appl. No.: 10/627,970

(22) Filed: Jul. 28, 2003

(65) Prior Publication Data

US 2005/0025622 A1 Feb. 3, 2005

(51) Int. Cl.[7] ..... F01O 5/18
(52) U.S. Cl. ..... 416/1; 416/96 R; 416/97 R
(58) Field of Search ..... 415/1, 115, 116; 416/1, 96 R, 96 A, 97 R

(56) References Cited

U.S. PATENT DOCUMENTS

| | | | | |
|---|---|---|---|---|
| 4,626,169 | A | | 12/1986 | Hsing et al. |
| 4,674,955 | A | | 6/1987 | Howe et al. |
| 4,820,122 | A | | 4/1989 | Hall et al. |
| 4,820,123 | A | | 4/1989 | Hall |
| 4,822,244 | A | | 4/1989 | Maier et al. |
| 5,151,012 | A | | 9/1992 | Hough |
| 5,403,156 | A | | 4/1995 | Arness et al. |
| 5,984,636 | A | * | 11/1999 | Fahndrich et al. ..... 416/96 R |
| 6,036,440 | A | | 3/2000 | Tomita et al. |
| 6,059,529 | A | | 5/2000 | Schiavo |
| 6,092,991 | A | | 7/2000 | Tomita et al. |
| 6,176,677 | B1 | | 1/2001 | Chévrefils et al. |
| 6,186,741 | B1 | | 2/2001 | Webb et al. |
| 6,224,328 | B1 | | 5/2001 | Weigand et al. |
| 6,382,914 | B1 | | 5/2002 | Tressler |
| 6,468,032 | B2 | | 10/2002 | Patel |
| 2002/0119045 | A1 | | 8/2002 | Starkweather |

FOREIGN PATENT DOCUMENTS

| | | |
|---|---|---|
| DE | 38 35 932 A1 | 4/1990 |
| EP | 0 649 975 A1 | 4/1995 |
| EP | 1 251 243 A1 | 10/2002 |
| GB | 2 225 063 A | 5/1990 |

* cited by examiner

*Primary Examiner*—Christopher Verdier
(74) *Attorney, Agent, or Firm*—Ogilvy Renault LLP

(57) ABSTRACT

An internally cooled turbine blade including at least one deflector extending into an air cavity generally from a first wall towards a second wall for diverting cooling air away from the first wall and generally towards the second wall to thereby improve cooling flow distribution among a plurality of cooling path inlets.

34 Claims, 9 Drawing Sheets

BLADE INLET COOLING FLOW DEFLECTOR APPARATUS AND METHOD

BACKGROUND OF THE INVENTION

1. Field of the Invention

The present invention relates to the cooling of components exposed to hot gas atmosphere and, more particularly, pertains to internally cooled gas turbine engine airfoil structures.

2. Description of the Prior Art

Referring to FIG. 6A, conventional internally-cooled turbine rotors typically comprise a disc 2 supporting a plurality of circumferentially-spaced turbine blades 1 having at least one internal cooling channel 5 defined therein, the cooling channel having an entrance opening 6. Often, there is more than one such channel, and FIGS. 6B and 6C shows three such channels, for example, labelled X, Y and Z for convenience. The root 3 of each of the blades is positioned in a slot in the disc. Defined between the blade and the disc is a cooling air channel or pocket 4 which communicates with the blade internal cooling channel via the entrance 6. In use, the cooling air pocket is fed with cooling air, for example from a tangential onboard injector (TOBI) or other means, and from there flows through the entrances 6 and into the internal cooling channels 5 for the purpose of cooling the blade.

The high rotational velocity of the turbine rotor relatively to the cooling air supply makes it generally difficult to feed the blade internal cooling passages. Air must be redirected several times, at several angles which are almost normal to each other, which is exceedingly difficult to do efficiently in high speed rotating machinery. Although the TOBI provides a partial solution, as depicted in FIG. 6B the air entering the cooling air pocket tends to generate a considerable re-circulation vortex inside the pocket, the vortex being caused by air entering the pocket at an angle (due to relative rotation of the disc) and then impacting and being redirected by a "downstream" first side of the pocket (the downstream side of the pocket is depicted along the bottom of FIG. 6B) and thus guided therealong to the back of the pocket. The difficulty in directing air results in an uneven cooling flow split among the various blade entry cooling passages. Referring to FIGS. 6B and 6C, the uneven cooling flow split tends to result in a larger percentage of the overall cooling flow entering passage Z (represented generally in FIGS. 6B and 6C by the disproportionate arrow sizes), which thereby reduces the efficiency of the cooling achieved through passages X and Y.

EP 1251243, published on Oct. 23, 2002, speculates that an air distribution problem between passages is caused by a low pressure region in the centre of the re-circulation vortex (which pressure is generally lowest at the point corresponding to the location of passage Y), and thus teaches installing a fence on the under-surface of the blade root to extend into the pocket and disrupt the swirl of cooling air. The U-shaped metal sheet EP 1251243 appears to act as a flow splitter, which attempts to break the vortex structure of the coolant flow, to thereby prevent the formation of low pressure zone inside the cooling air channel.

Though EP 1251243 may offer some improvement, there is still a need for an improved means for supplying a coolant air flow to internally cooled airfoil blade which will provide a better pressure and flow distribution between cooling passages with the blade.

SUMMARY OF THE INVENTION

It is therefore an aim of the present invention to provide a new blade inlet cooling flow deflector for controlling the split of air entering each internal cooling passages of a turbine blade.

It is a further aim of the present invention to improve the pressure field distribution profile at the root of the blade feed passages.

Therefore, in accordance with the present invention, there is provided an internally cooled turbine blade and a rotor disc for a gas turbine engine, the turbine disc and the turbine blade cooperating to form an air cavity therebetween, the air cavity having a first wall extending radially relative to the turbine disc and along a direction generally parallel to a rotation axis of the turbine blade, the first wall in use being adapted to redirect a flow of cooling air entering the cavity towards a downstream end of the cavity, the turbine blade comprising a series of inlets communicating with the air cavity and with internal cooling passages defined inside the turbine blade, and at least one deflector having a backing surface in mating engagement with said first wall and a flow surface extending only partly across said air cavity to force all of the cooling air to flow on a side of said deflector opposite said backing surface thereof.

In accordance with a further general aspect of the present invention, there is provided an internally cooled turbine blade having a root portion received in a blade attachment slot defined in a rotor disc, the turbine blade comprising a plurality of internal cooling flowpaths each having at least one inlet defined in a surface of said root portion for allowing a flow of cooling air to pass from the blade attachment slot into said internal cooling flowpaths, and at least one deflector extending from one side of said surface partly across a width thereof, said deflector acting on the flow of cooling air inside the blade attachment slot to create a vortex structure having a region of lowest pressure which is deflected at a location remote from said inlets, thereby minimizing air cooling pressure losses at said inlets.

In accordance with a further general aspect of the present invention, there is provided a turbine blade adapted to be mounted to a turbine disc, the blade being further adapted to cooperate with the disc to form an air cavity therebetween, the air cavity having a first wall extending radially relative to the turbine disc and along a direction generally parallel to a turbine disc axis of rotation, the first wall in use adapted to redirect a flow of cooling air entering the cavity towards a downstream end of the cavity, the air cavity further having a second wall generally parallel to the first wall, the turbine blade comprising: an array of inlets extending along the cavity from a first inlet to a last inlet, the last inlet being closest to the cavity downstream end, the inlets leading to internal cooling passages defined inside the turbine blade; and at least one deflector adapted to extend from the first wall, the deflector being located upstream of the last inlet, the deflector being adapted to redirect the flow of cooling air from the first wall towards the second wall.

In accordance with a still further general aspect of the present invention, there is provided a method of supplying a coolant flow to an internally cooled turbine blade of the type having a root portion defining a coolant inlet, the root portion being received in a blade attachment slot defined in a rotor disc of a gas turbine engine, the method comprising the steps of: a) directing a swirl of coolant into said blade attachment slot, and b) pushing a low pressure region of the swirl of coolant away from said coolant inlet by deflecting the coolant inside the blade attachment slot while substantially preserving the swirling nature of the coolant flow.

In accordance with a still further general aspect of the present invention, there is provided a method of regulating the split of cooling air supplied to at least three cooling inlets leading to cooling passages defined inside at least one rotating airfoil in a gas turbine engine, the rotating airfoil being mounted to a rotary disc and cooperating therewith to form an air cavity therebetween, the air cavity having an entrance for admitting cooling air thereto, a downstream end at an end of the cavity opposite the entrance, and a sidewall extending radially along a disc radial axis and axially between the entrance and the downstream end, the inlets communicating with the air cavity and arranged in an array extending along the air cavity from a first of said inlet to a last of said inlets, the last inlet being closest to the cavity downstream end, the method comprising the steps of: a) rotating the rotary disc with the at least one rotating airfoil mounted thereto; b) directing cooling air into the air cavity through the entrance and substantially along the sidewall towards the downstream end; and c) at a position intermediate the entry and downstream end, directing air away from said sidewall towards at least one inlet upstream of the last inlet.

The step of deflecting the cooling air may be done to cause a pressure rise in the flow at a position corresponding to at least one inlet relative to an undeflected flow.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
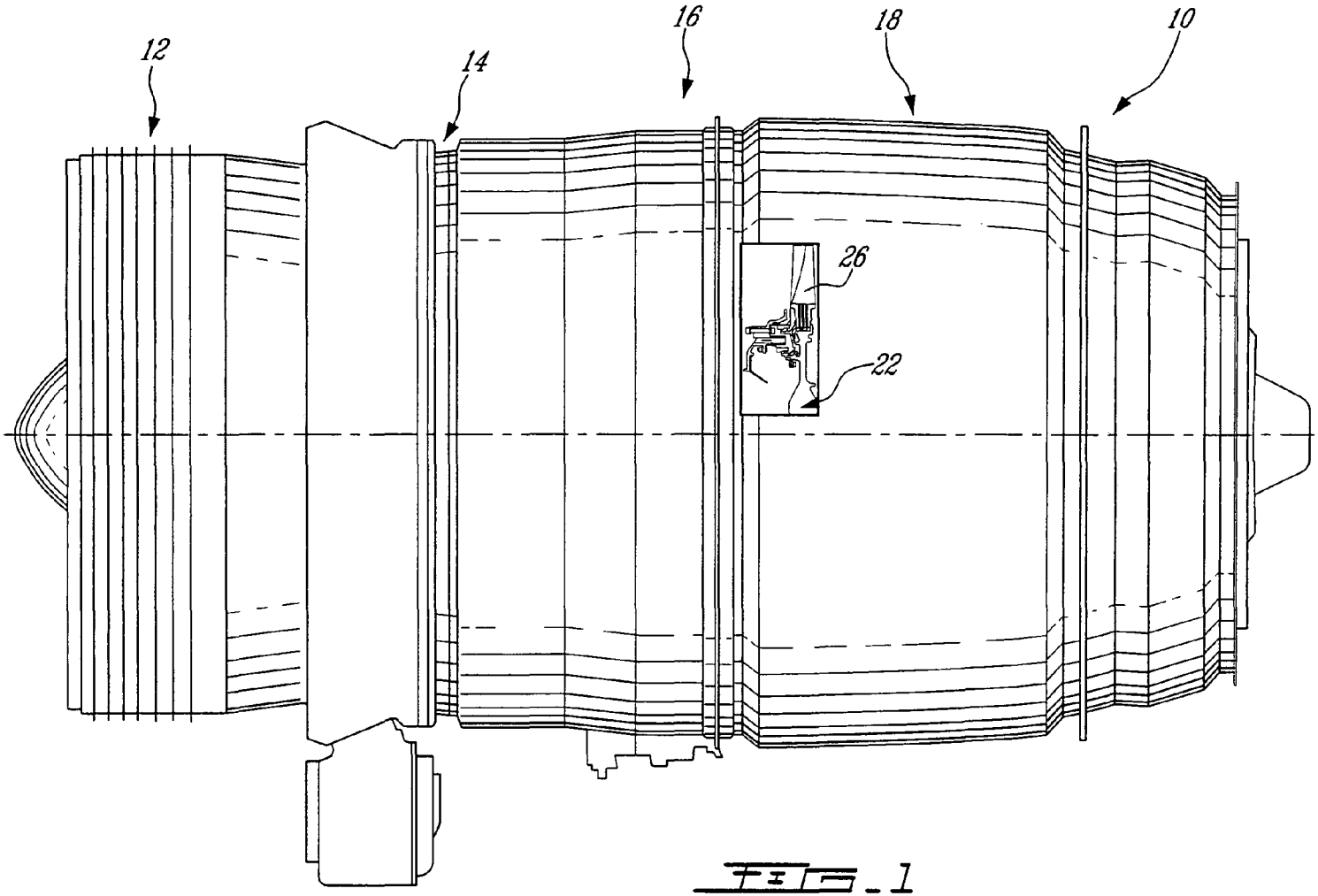
FIG. 1 is a side view, partly broken away, of a gas turbine engine to which an embodiment of the present invention is applied.

FIG. 1 illustrates a gas turbine engine 10 generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases.

Figure 2:
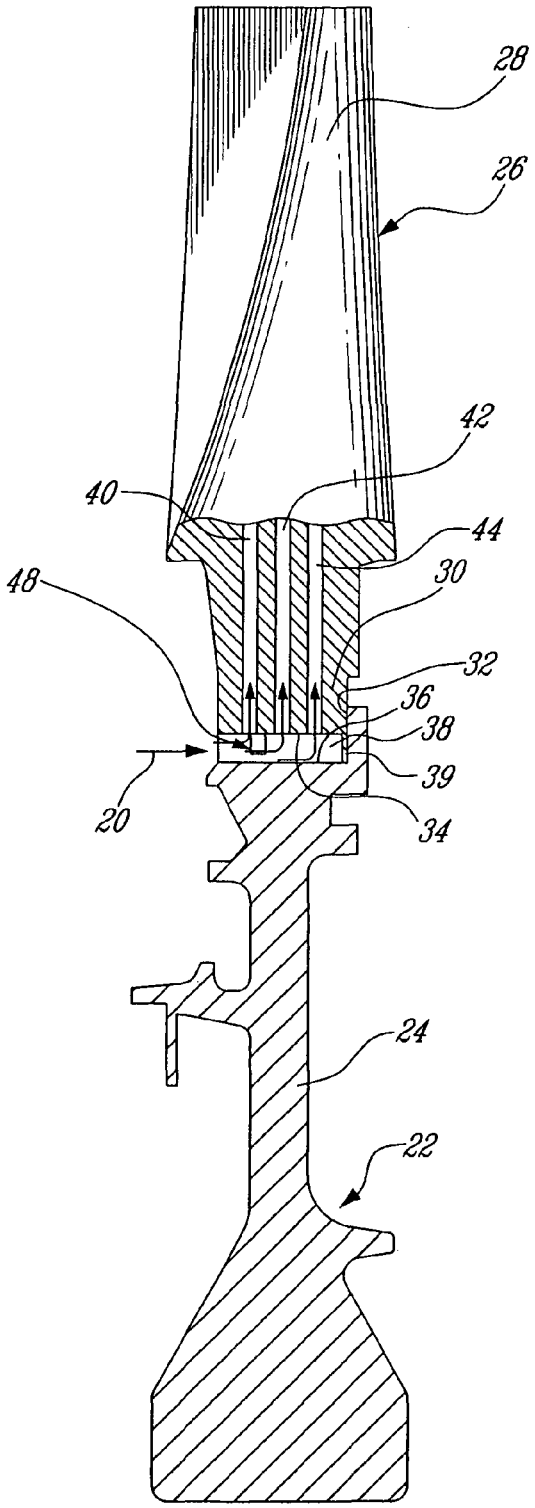
FIG. 2 is an axial cross-sectional view of a portion of a turbine section of the gas turbine engine showing a blade inlet cooling flow deflector at the root of a turbine blade in accordance with a preferred embodiment of the present invention.

As depicted by arrows 20 in FIG. 2, a portion of the air coming from the compressor 14 (or any other source of coolant) is provided to the turbine 18 for cooling purposes. The turbine 18 comprises, among others, a rotor 22 having a disc 24 securely mounted to the engine shaft (not shown) linking the turbine 18 to the compressor 14. The disc 24 carries at its periphery a plurality of circumferentially distributed blades, one of which is shown at 26.

Figure 3:
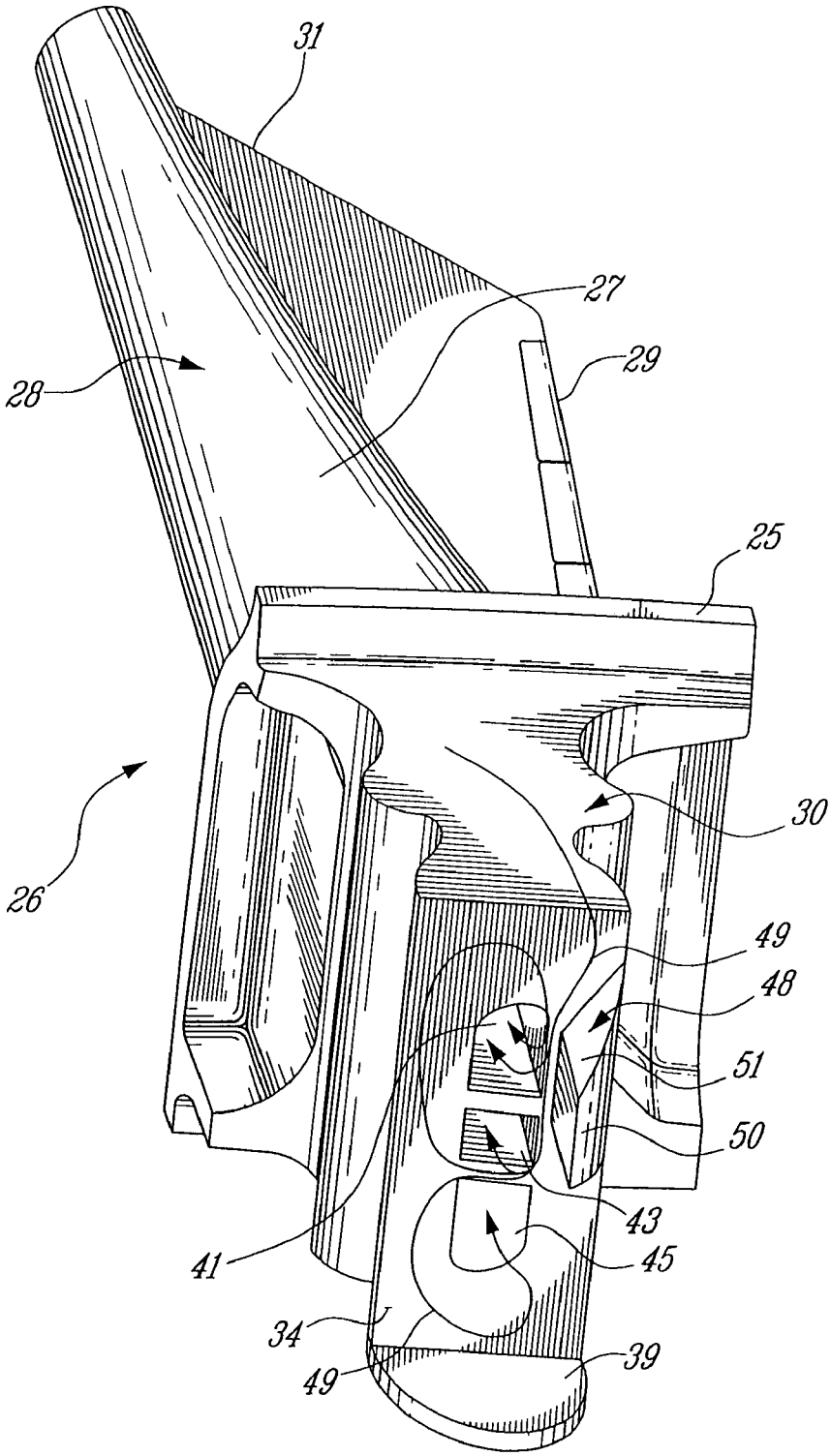
FIG. 3 is a perspective bottom view of the turbine blade with the blade inlet cooling flow deflector depending from an undersurface of the blade root.

As shown in FIG. 3, each blade 26 has an airfoil portion 28 having a leading edge 27, a trailing edge 29 and a tip 31. The airfoil portion 28 extends from a platform 25 provided at the upper end of a root portion 30. The root portion 30 is captively received in a blade attachment slot 32 (FIG. 2) defined in the outer periphery of the disc 24. The root portion 30 is typically formed in a fir tree configuration to cooperate with mating serrations in the blade attachment slot 32 to resist centrifugal dislodgement of the blade 26.

As shown in FIG. 2, the undersurface 34 of the root portion 30 is spaced from the bottom wall 36 of the slot 32 to form therewith an axially extending (relative to the disc axis of rotation) blade cooling entry channel or cavity 38. The channel 38 is closed at a downstream end thereof by a rear tab 39 depending from the undersurface 34 of the root portion 30. The channel 38 extends from an entrance opposing the downstream end, and is further defined by a pair of sidewalls 53 which are oriented in a plane generally parallel to a plane defined by the disc axis of rotation and the disc radius (though it will be understood that the sidewalls 53 are neither planar themselves, nor exactly parallel to the mentioned plane). The channel 38 is in fluid flow communication with a blade internal cooling flowpath including a plurality of axially spaced-apart cooling air passages 40, 42 and 44 extending from the root to the tip of the blade 26.

As shown in FIG. 3, the cooling air passages 40, 42 and 44 have respective inlet openings 41, 43 and 45 defined in an array in the undersurface 34 of the root portion 30. According to the present invention, and as will be described in more detail below, the flow of cooling air directed into the blade cooling entry channel 38 is distributed to the internal cooling passages 40, 42 and 44 in a predetermined proportion by a blade inlet cooling flow deflector 48 located along a portion of a pressure side of the root portion 30 of the blade 26 (i.e. from a first sidewall 53*a*, as will be described in more detail below).

Figure 4:
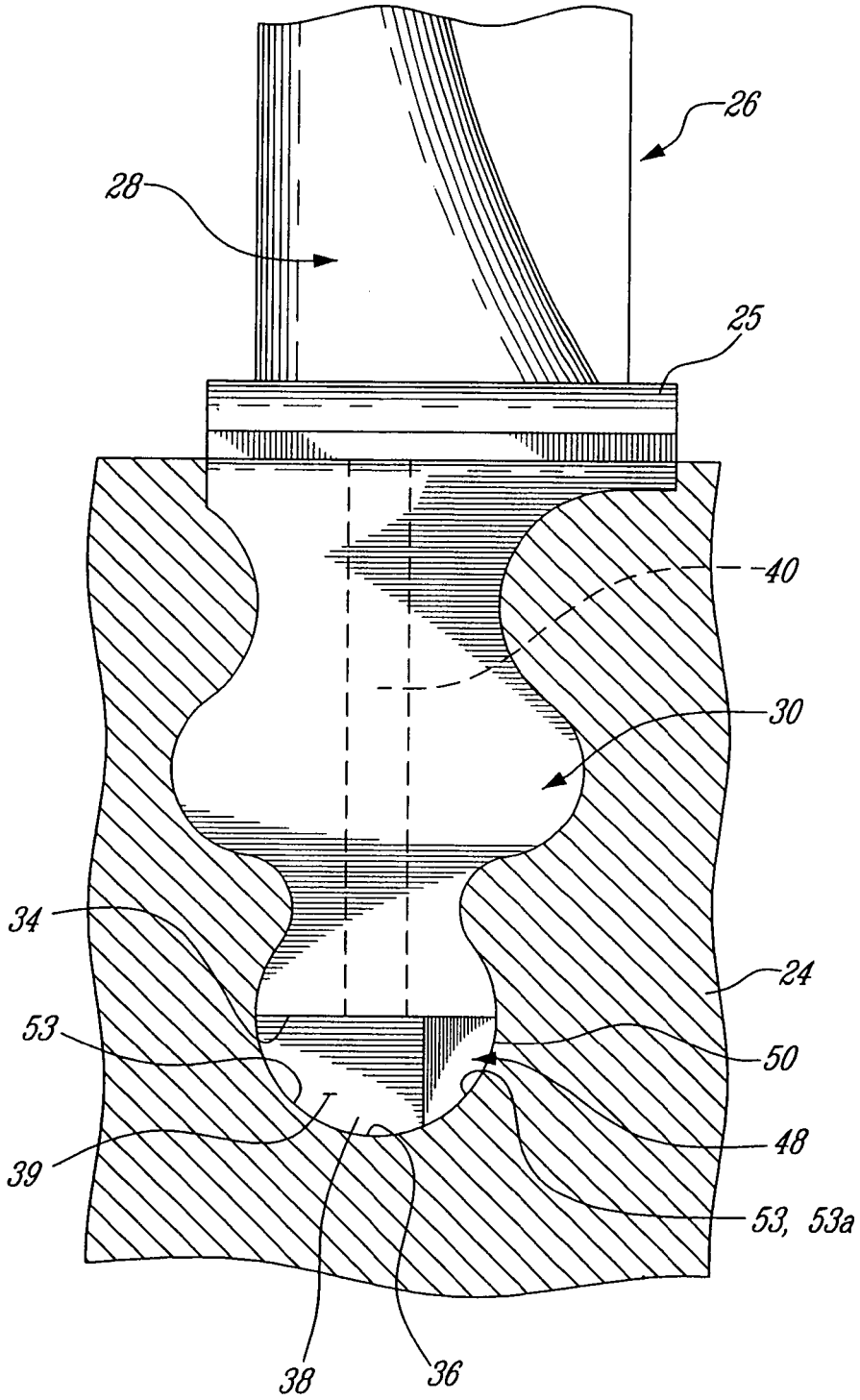
FIG. 4 is a front cross-sectional view of the turbine blade root portion received in a blade attachment slot defined in the periphery of a rotor disc.

The deflector 48 is preferably provided as a downwardly depending projection integrally cast with the blade 26. The deflector 48 projects downwardly from the blade undersurface 34 and is located upstream from the downstream end of channel 38 (i.e. the end defined by tab 39), at a position intermediate the entrance of channel 38 and this downstream end of channel 38, and preferably adjacent the inlet 41 of the first cooling passage 40 (i.e. the leading edge cooling passage). As shown in FIG. 4, the deflector 48 has a curved backing surface 50 adapted to matingly engage the sidewall 53*a* and the deflector 48 preferably extends generally normally from sidewall 53*a* in order to form a throat in the channel 38. The deflector 48 has a curved flow leading edge surface 51 over which the cooling air entering the channel 38 is deflected in a direction away from the sidewall 53*a*. It will be understood that, due to the relative movement between the rotating turbine disc and the supplied cooling air, cooling air entering channel 38 generally does so at an angle to sidewall 53*a*, and therefore tends to be redirected by sidewall 53*a*. This redirection tends to set up a swirl or vortical flow for the coolant air in chamber 38, as is also described in U.S. Patent Application Publication 2004/0115054 filed by Balland at al., the contents of which is hereby fully incorporated by reference into this description. Sidewall 53*a* is the sidewall which is downstream of the opposing sidewall 53 relative to the flow of coolant air entering the chamber 38—i.e. sidewall 53*a* is the one which first meets the coolant flow entering the chamber.

Figure 6A:
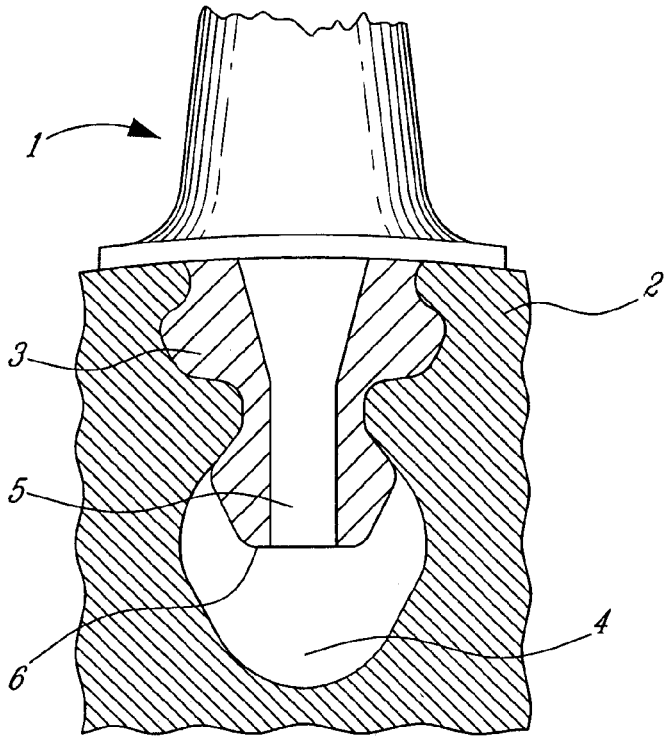
FIG. 6A (Prior Art)
FIGS. 6A–6C are, respectively, a cross-sectional view of, and 2-D and 3-D schematic representations of the air flow within, a typical prior art structure.
Figure 6B:
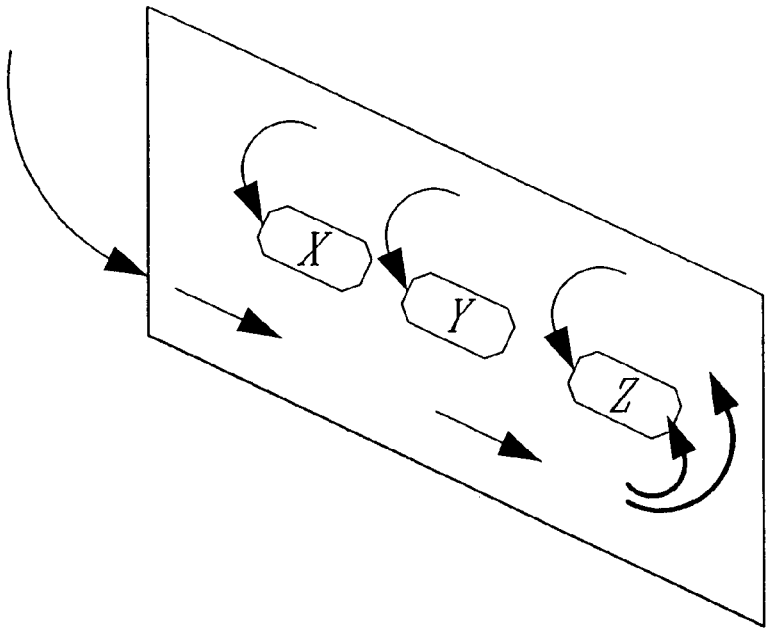
FIG. 6B (Prior Art)
Figure 6C:
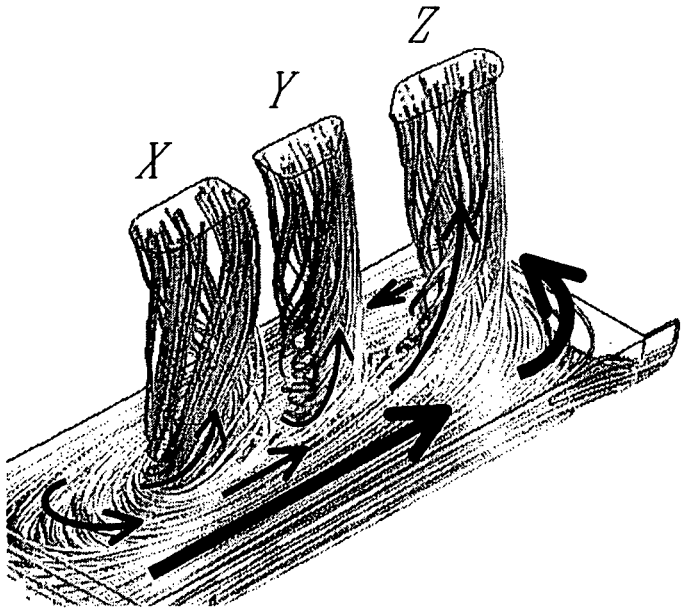
FIG. 6C (Prior Art)
Figure 7A:
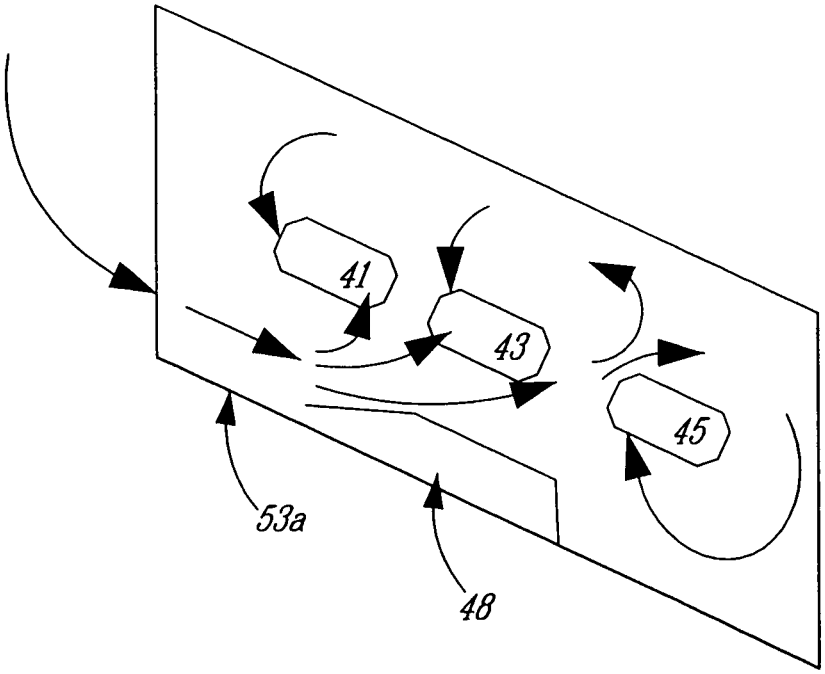
FIGS. 7A–7B are, respectively, a 2-D and a 3-D schematic representation of the air flow according to the present invention (wherein the air flow is represented by both arrows and a plurality of 'string-like' flow lines, the density of the flow lines corresponding roughly to relative pressures in the air flow)
Figure 7B:
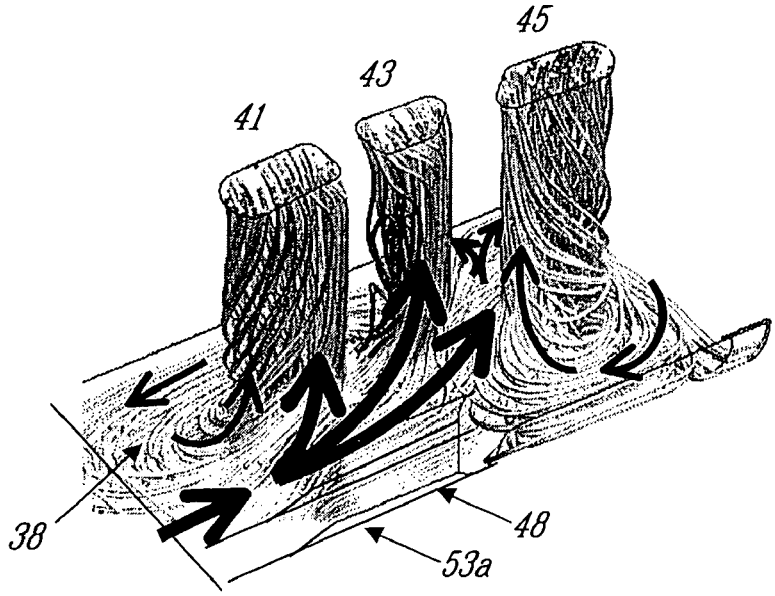

In use, a flow of cooling air entering the channel 38 has a tendency to flow to the side of the channel 38 corresponding to the pressure side of the blade 26, by reason of the direction and speed of rotation of the disc relative to the cooling air supply. Thus, as air enters air channel 38, it is redirected by the sidewall 53 corresponding to the pressure side of the blade 26 (indicated by reference numeral 53*a* in the Figures) and thereby guided towards the downstream end of the cavity. As described in the Background above, this asymmetrical entrance of cooling air into channel 38 tends to cause an undesirable vortex in the prior art which can lead to unbalanced air flows into the array of cooling inlets in the blade. In the present invention, however, by providing the deflector 48 on the pressure side sidewall 53*a*, the cooling air flow is not directly split but rather deflected away from sidewall 53*a* and towards the cooling holes, which are typically aligned generally along a central axis of the channel 38. Preferably, the angle of at least a portion of the defector 48, such as the leading edge 51 thereof is acute relative to, and facing upstream into, the direction of the cooling flow entering the channel 38, so as to thereby smoothly guide the flow away from sidewall 53*a* and generally towards the other sidewall 53. Refining to FIGS. 7A and 7B, most preferably, the deflector 48 is adapted to guide the cooling air flow towards at least one inlet upstream of the last inlet 45 (i.e. one or more of inlets 41 and 43). to thereby balance the cooling flows between the plurality of inlets as desired. (Relative arrow size in FIG. 7B is intended to represent the relative size of the main cooling flow components entering the inlets.) The designer may adjust the position and configuration of deflector 48 to achieve the designed balance between the flows entering inlets 41,43 and 45. The centre of the vortex, which is a low pressure region and which is in a position corresponding with the location of an intermediate inlet in the prior art of the type depicted in FIGS. 6A–6C, is with the present invention "pushed" generally away from the air cooling inlets 41, 43 and 45 and weakened so that the cooling air may enter the blade 26 with minimal pressure losses. The deflector also pushes the airflow towards the inlets themselves, preferably so that no inlet location corresponds to a vortex-generated low pressure region. By so appropriately modifying the structure of the vortex, as opposed of breaking it, the cooling air can flow more directly and smoothly into the blade 26. In this way, coolant pressure losses can be minimized, particularly at the leading edge cooling passage 40. This prevents having to increase the pressure at which the cooling air is supplied to the blade cooling entry channel 38, and permits a more even distribution between cooling passages.

Figure 8A:
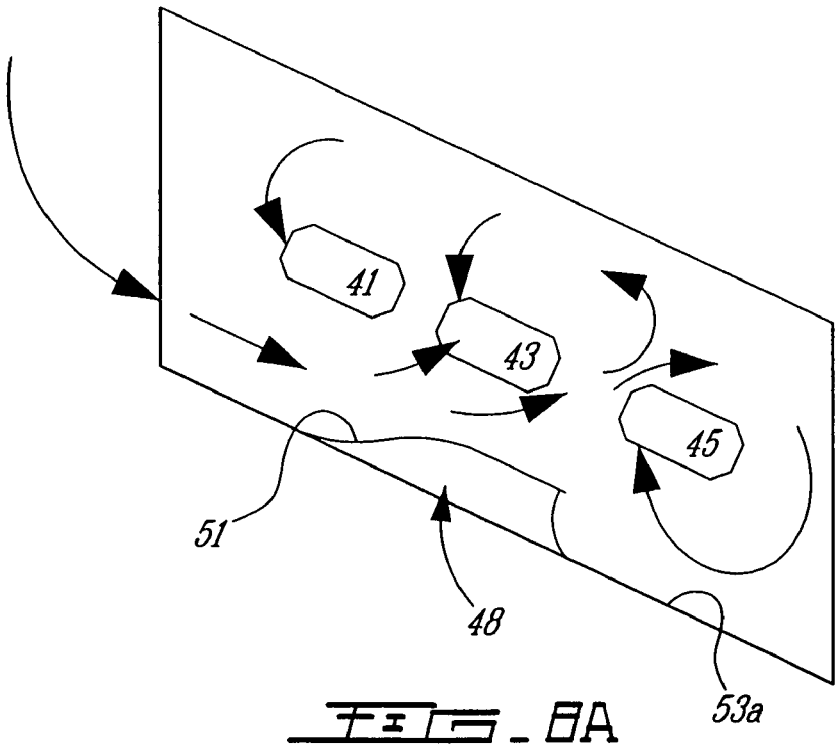
FIGS. 8A–8B are 2-D schematic representations of the air flow according to alternate embodiments of the present invention.
Figure 8B:
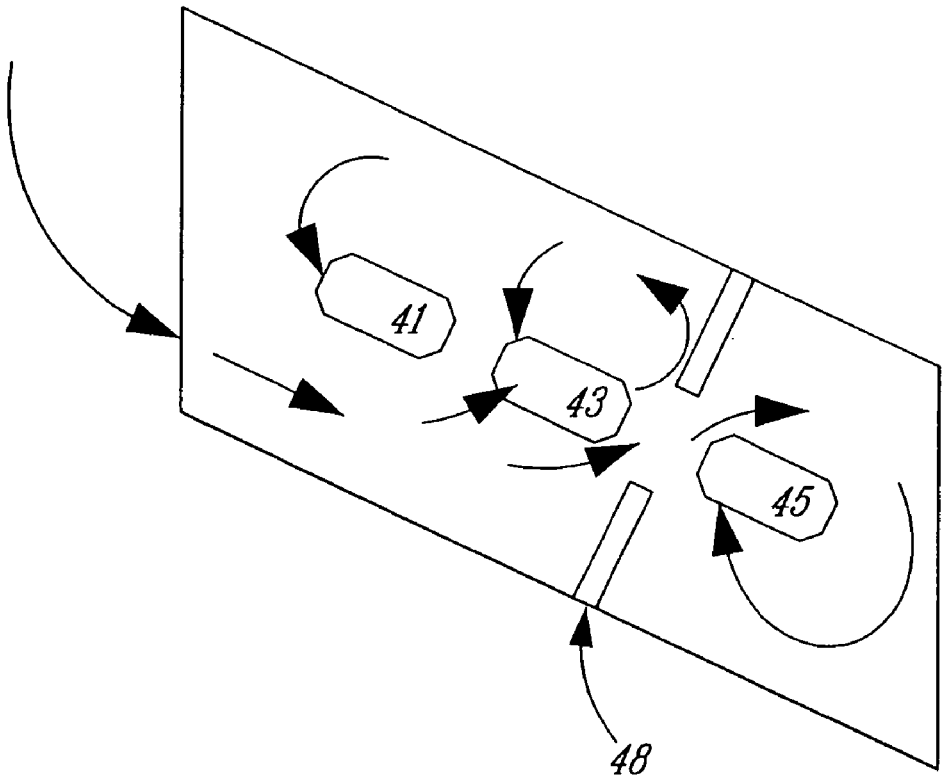

As can be seen from arrows 49 in FIG. 3, the deflector 48 is preferably aerodynamically shaped and positioned to redirect the flow travelling along sidewall 53*a* inside the blade cooling entry channel 38 in such a way as to redirect the flow more towards the forward passages 40 and 42. More particularly, as mentioned above, the deflector 48 preferably has an inclined surface 51. which deflects a portion of the incoming air directly into the leading edge passage 40 and the passage 42, to thereby permit the flows entering 41, 43 and 45 to be balanced as desired. According to the embodiment in FIGS. 7A and 7B, the leading edge 51 is planar and projects laterally outwardly from the sidewall 53*a*. However, it is understood that the leading edge 51 could be curved in any desired shape as well, as shown in FIG. 8A. In fact, the deflector 48 may adopt various configurations depending on the number of inlets, the position and the size of the inlets, and the profile of the coolant flow entering the channel 38, as discussed further below. The role of the deflector 48 is to improve the pressure field distribution at the root of the blade cooling passages 40, 42 and 44 by changing the vortex structure of the flow so tat the low pressure region associated therewith be as far as possible from the coolant inlets 41, 43 and 45. The deflector 48 causes the cooling air flow to swirl in at least a pair of smaller counter-rotating vortices.

In the prior art (e.g. FIGS. 6A–6C), the vortex under the blade is generally the result of air being redirected once it reaches the back of the pocket, however, it is not the vortex which presents the problem for flow balance, but rather the coincidence of a vortex centre with an inlet location. Rather than completely disrupt or choke the cooling flow, as prior art like EP application no. 1,251,243 does, the present invention rather seeks simply to redirect the flow of incoming air to the air inlets specifically as desired, which permits the flows to be balanced among inlets as desired, and also permits vortices to be managed so that their centres can be positioned in relation to inlet locations more or less as desired.

Figure 5:
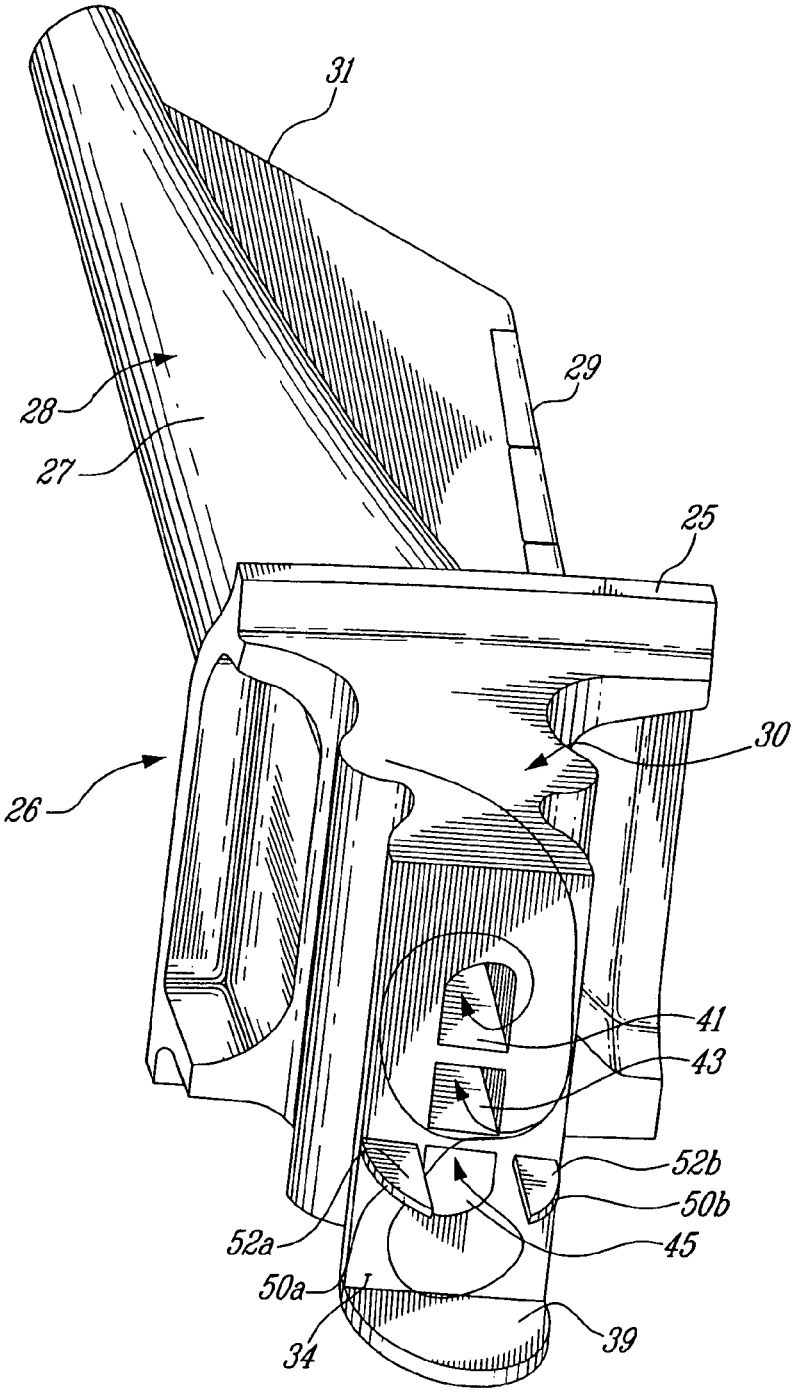
FIG. 5 is a perspective view of a turbine blade provided with a blade inlet cooling flow deflector in accordance with a second embodiment of the present invention.

FIG. 5 shows another embodiment of the present invention, wherein like elements are identified by like reference numerals. This embodiment essentially differs from the one of FIG. 3 in that more than one deflector is provided, in the form of a pair of downwardly-depending transversal tabs 52*a* and 52*b* extending at right angles from the underside 34 of the root portion 30 of the blade 26 on opposed sides of the third inlet 45 (i.e. the one feeding the last or trailing edge cooling passage), and that the leading edges of the deflectors are more or less normal to the cooling flow entering the channel 38. The tab 52 extends generally normally from sidewall 53*a*. The tab 52*b* extends generally normally from the other sidewall 53. Both are located on the sidewalls at a position upstream of the downstream end of channel 38 and the last inlet hole. The tabs 52*a* and 52*b* project crosswise and preferably less than half way into the channel 38 from opposed sides thereof (i.e. sidewalls 53). Each tab 52 has a curved backing surface 50 to cooperate with the curvature of the sidewall 53 of the blade attachment slot. The tabs 52*a* and 52*b* are flat and define a constricted passage or throat therebetween for limiting the flow of cooling air to the third inlet 45. In this embodiment, the deflector components cooperate to deflect the air flow to thereby somewhat prefer the second air cooling inlet 43 over the third one 45, to thereby counterbalance the natural preference for the last cooling inlet 45. Like the embodiment of FIG. 3, the single vortex of the cooling air inside the cooling channel of the prior art is modified into a multiple weaker vortices, with the major portion of the volume of air forming a first vortex feeding the first two inlets 41 and 43 and the remaining portion of the air forming the second vortex feeding the third inlet 45. As a further embodiment, only one tab 52*a* may be provided, located as desired by the designer, to provide a desired balance to the air flow under the blade.

It is pointed out that the present invention can also be used in conjunction with internally cooled turbine airfoil structures having a single cooling inlet. In this case, the deflector(s) would not dictate the split of air between the various entrances but would still weaken the vortex structure, thereby minimizing the pressure loses resulting from air re-circulation in the blade cooling entry channel. The designer may, in light of the teachings herein, modify the number, configuration, placement and/or structure of the embodiments presented as exemplary of the present invention above to provide any number of further embodiments to achieve the present invention. For example, rather than deflecting the flow immediately upon entering the cavity (i.e. away from wall 53*a*), the flow may instead be deflected by a deflector extending from the wall 53 opposite wall 53*a*, such that the cooling flow enters the cavity, proceeds undiverted (i.e. by any deflecting apparatus) along wall 53*a* to the rear of the cavity and from there then recirculates back up the wall 53 opposite wall 53*a* before being there diverted away from opposite wall 53 (i.e. by a deflector arranged according to the teachings above to extend from opposite wall 53) to then redirect air towards an intermediate inlet. In other words, the deflector may be positioned further downstream relative to the initial cooling air vortex in the cavity. Furthermore, though the invention is described as a means of "balancing" relative flows, it may also be used to 'unbalance' flows, as desired. Therefore, these and other modifications apparent to those skilled in the art are intended by the inventors to be within the scope of this invention and, therefore, within the scope of the appended claims.

What is claimed is:

1. In combination, an internally cooled turbine blade and a rotor disc for a gas turbine engine, the turbine disc and the turbine blade cooperating to form an air cavity therebetween, the air cavity being defined by a disc first wall extending generally radially relative to the turbine disc and along a general direction of a rotation axis of the rotor disc, a disc second wall extending generally parallel to the first wall, an upstream entry end and a downstream end, a flow of cooling air in use entering the air cavity generally at an angle to the first wall by reason of rotation of the air cavity relative to the flow of cooling air, the first wall thereby in use redirecting the flow of cooling air entering the cavity towards the downstream end of the cavity, the turbine blade comprising a series of inlets communicating with the air cavity and with internal cooling passages defined inside the turbine blade, and at least one deflector extending into the air cavity, the deflector extending generally from said first wall to a position nearer to but remote from the second wall, the deflector thereby adapted to divert cooling air entering the cavity away from the first wall and generally towards the second wall.

2. A combination as defined in claim 1, wherein the deflector has a flow surface for contacting and diverting the cooling air flow, and wherein the flow surface extends away from the first wall at an acute angle.

3. A combination as defined in claim 1, wherein said deflector extends across said air cavity less than half the distance from said first to said second wall.

4. A combination as defined in claim 1, wherein said first wall is located on a side of the air cavity corresponding to a pressure side of the turbine blade.

5. A combination as defined in claim 1, wherein said series of inlets comprises a linear array of inlets extending from a first inlet to a last inlet, the last inlet being closest to the downstream end, and wherein said deflector is adapted to redirect the flow of cooling air towards at least one inlet, the at least one inlet being any of said inlets other than the last inlet.

6. A combination as defined in claim 1, wherein said deflector is located intermediate the upstream and downstream ends of the air cavity.

7. A combination as defined in claim 1, wherein said deflector has a leading surface relative to the cooling airflow and wherein the leading surface is non-perpendicular to the first wall.

8. A combination as defined in claim 1, wherein said deflector is adapted to cause the cooling air flow to swirl in at least a pair of counter-rotating principal vortices inside the air cavity.

9. A combination as defined in claim 1, further comprising a second deflector, the second deflector extending away from the second wall towards the first wall, the second deflector extending only part of the distance across the cavity towards the first wall.

10. A combination as defined in claim 1, wherein the air cavity is defined between a turbine blade root portion and a blade attachment slot defined in said rotor disc, the slot defining the first and second walls, and wherein said deflector integrally extends from said root portion.

11. An internally cooled turbine blade having a root portion adapted to be received in a blade attachment slot defined in a rotor disc, the turbine blade comprising:

a plurality of internal cooling flowpaths each having at least one inlet defined in a surface of said root portion, the plurality of inlets arranged in the surface generally in a linear array relative to one another, the linear array defining a linear axis, and at least one deflector extending from a peripheral side of said surface and partially across the surface towards an opposing peripheral side of the surface, said deflector having a principal face adapted to contact and redirect a cooling flow entering the slot, wherein said deflector is positioned on the blade such that the deflector is disposed substantially adjacent a sidewall of said blade attachment slot when the blade is installed on the rotor disc. the deflector thereby being adapted to redirect a flow cooling air in the slot generally away from the sidewall and towards an opposing sidewall of the slot.

12. An internally cooled turbine blade as defined in claim 11, wherein the face is disposed at an acute angle relative to said linear axis.

13. An internally cooled turbine blade as defined in claim 12, wherein said peripheral side corresponds to a pressure side of an airfoil of the turbine blade.

14. An internally cooled turbine blade as defined in claim 12, wherein said surface is an undersurface of said root portion.

15. An internally cooled turbine blade as defined in claim 11, wherein said deflector is located adjacent an inlet having an intermediate position in said linear array.

16. An internally cooled turbine blade as defined in claim 11, further comprising a second deflector.

17. An internally cooled turbine blade as defined in claim 15, wherein said deflector is adapted to redirect a flow of cooling air in the slot towards said intermediate inlet.

18. A turbine blade adapted to be mounted to a turbine disc to cooperate with the disc to form an air cavity therebetween, the air cavity having first and second opposing walls extending generally radially relative to the turbine disc and generally along a direction parallel to a turbine disc axis of rotation, the disc in use rotating relative a cooling air flow supplied to the cavity and the air cavity first wall thereby first redirecting the flow of cooling air entering the cavity, the turbine blade comprising:

a root portion having a surface adapted to partially define the air cavity when the blade is installed on the disc, the root portion having first and second sides corresponding to said first and second opposing walls, the first and second sides having respective ends which define respective ends of the surface;

an array of inlets extending along the surface, the inlets communicating with internal cooling passages defined inside the turbine blade; and at least one deflector extending from the surface and spanning the surface substantially from the first side to a position intermediate the first and second sides, the deflector being spaced apart from ends of the surface.

19. A turbine blade as defined in claim 18, wherein the deflector extends generally normally from the first side.

20. A turbine blade as defined in claim 18, wherein at least a portion of the deflector extends from the first side at an acute angle.

21. A turbine blade as defined in claim 18, wherein said intermediate position is closer to the first side than the second side.

22. A turbine blade as defined in claim 18, wherein said deflector is adapted to in use redirect cooling air flowing along the first side towards at least one inlet upstream of an ultimate inlet of said array of inlets.

23. A turbine blade as defined in claim 18, wherein said first side corresponds to a pressure side of an airfoil of said blade.

24. A turbine blade as defined in claim 18, wherein said deflector is integral with said root portion.

25. A turbine blade as defined in claim 22, wherein said deflector is adapted to in use divert cooling air to increase an amount of cooling air flowing into said at least one inlet.

26. A method of supplying a coolant flow to an internally cooled turbine blade, the blade having a root portion defining a plurality of coolant inlets, the root portion being received in a blade attachment slot defined in a rotor disc of a gas turbine engine, the method comprising the steps of: a) directing a swirl of coolant into said blade attachment slot, and b) deflecting the coolant inside the blade attachment slot while inducing a new vortex structure to the swirl of coolant to thereby prevent a low pressure region from forming in a position corresponding to a centre coolant inlet.

27. A method as defined in claim 26, wherein the deflector does not directly split a primary swirl flow entering the slot.

28. A method as defined in claim 27, wherein step b) includes the step of dividing the swirl into a plurality of smaller principal swirls.

29. A method of regulating the division of a flow of cooling air supplied to at least three cooling inlets leading to cooling passages defined inside a rotating airfoil in a gas turbine engine, the rotating airfoil being mounted to a rotary disc and co-operating therewith to form an air cavity therebetween, the air cavity having an entrance for admitting cooling air thereto, a downstream end at an end of the cavity opposite the entrance, and a sidewall extending radially along a disc radial axis and axially between the entrance and the downstream end, the at least three inlets communicating with the air cavity and arranged in an array extending along the air cavity from a first of said inlets to a last of said inlets, the last inlet being closest to the cavity downstream end, the method comprising the steps of:

a) rotating the rotary disc with the airfoil mounted thereto;

b) directing cooling air into the air cavity through the entrance and substantially along the sidewall towards the downstream end; and c) at a position intermediate the entry and downstream end, directing cooling air away from said sidewall and dividing a primary swirl of cooling air into smaller swirls.

30. A method as defined in claim 29, wherein step c) includes increasing the pressure in the cooling flow at a position corresponding to the at least one intermediate inlet relative to a pressure resulting from an undeflected flow.

31. A method as defined in claim 29, wherein the cooling air has a vortical nature, and wherein step c) comprises pushing a low pressure region of a vortex of cooling air away from the at least one middle inlet while substantially preserving the vortical nature of the cooling flow.

32. A method as defined in claim 31, wherein step c) comprises the step of rearranging a vortex structure of the cooling flow into two counter-rotating swirl flows.

33. A method as defined in claim 31, wherein step c) comprises the step of rearranging a vortex structure of the cooling flow.

34. A method as defined in claim 33, wherein the root portion extends only partly across a width of a surface of the airfoil on which the portion is located.

* * * * *